United States Patent [19]

Yamanaka et al.

[11] Patent Number: 4,714,501

[45] Date of Patent: Dec. 22, 1987

[54] METHOD FOR THERMAL TREATMENT OF ALLOY FOR HEAT TRANSFER PIPES

[75] Inventors: Kazuo Yamanaka, Minooshi; Hiroo Nagano, Kobeshi; Takao Minami, Amagasakishi; Yaautaka Okada, Narashi; Mamoru Inoue, Kobeshi; Hiroshi Susukida, Takasago; Kichiro Onimura, Takasago; Toshio Yonezawa, Takasago; Nobuya Sasaguri, Takasago; Katsuji Kawaguchi, Takasago; Takaya Kusakabe, Kobe, all of Japan

[73] Assignees: Mitsubishi Jukogyo Kabushiki Kaisha, Tokyo; Sumitomo Metal Industries, Ltd., Osaka, both of Japan

[21] Appl. No.: 798,702

[22] Filed: Nov. 15, 1985

Related U.S. Application Data

[63] Continuation of Ser. No. 550,022, Nov. 8, 1983, abandoned.

[30] Foreign Application Priority Data

Aug. 29, 1983 [JP] Japan ..... 58-156427

[51] Int. Cl.[4] ..... C22F 1/10

[52] U.S. Cl. ..... 148/13; 148/158; 148/162

[58] Field of Search ..... 148/13, 158, 162, 410, 148/419, 427, 428, 442; 420/448

[56] References Cited

U.S. PATENT DOCUMENTS

| | | | |
|---|---|---|---|
| 3,303,531 | 2/1967 | Ogden | 420/584 |
| 3,573,901 | 4/1971 | Economy | 420/448 |

FOREIGN PATENT DOCUMENTS

| | | |
|---|---|---|
| 483744 | 8/1917 | France . |
| 2001576 | 9/1969 | France . |

*Primary Examiner*—R. Dean

*Attorney, Agent, or Firm*—Toren, McGeady & Associates

[57] ABSTRACT

An alloy for heat transfer pipes excellent in an alkali stress corrosion cracking resistance which is obtained by heating and retaining said alloy at a temperature within the range of a temperature (T°C.), at which a carbide in said alloy is thoroughly solubilized, to T+100° C. for 1 minute or more; cooling it once to a level of 200° C. or less; and carrying out a thermal treatment under conditions within a hatched range Z in FIG. 2, said alloy comprising: in terms of % by weight, 0.15% or less of C; 1.0% or less of Si; 1.0% or less of Mn; 25 to 35% of Cr; 40 to 70% of Ni; 0.5% or less of Al; 0.01 to 1.0% of Ti; 0.5 to 5.0%, in all, of one or more of Mo, W and V; 0.30% or less of P; 0.020% or less of S; and the residue of Fe and impurities.

1 Claim, 3 Drawing Figures

METHOD FOR THERMAL TREATMENT OF ALLOY FOR HEAT TRANSFER PIPES

This application is a continuation of abandoned application Ser. No. 06/550,022 filed Nov. 8, 1983.

FIELD AND BACKGROUND OF THE INVENTION

The present invention relates to an alloy for a heat transfer pipe, particularly to an alloy for a heat transfer pipe on the secondary side of a nuclear reactor.

Presently, a heat transfer pipe of a steam generator in a nuclear reactor such as a pressurized water reactor is made of an only annealed alloy or Alloy 600 (trade name, 75%Ni-15%Cr-8%Fe) which has further been subjected to a specific thermal treatment (700° C.×15 hr). However, recent researches have revealed that Alloy 600 which is the alloy for the heat transfer pipe has the following problems. That is to say, a stress corrosion cracking sometimes occurs owing to an alkaline concentrate in the gap between the heat transfer pipe and a pipe-supporting plate in environments (alkaline environments including ammonia and hydrazine and having a pH of 9.2 to 9.5 and a temperature of 280° C.) on the secondary side of the nuclear reactor, and a pitting corrosion tends to take place owing to $Cl^-$ ions in leaked seawater in the same environments on the secondary side of the nuclear reactor. Further, this pitting corrosion will deeply penetrate and the number of the pitting corrosions will augment with the increase in a concentration of the $Cl^-$ ions.

Heretofore, it is known that the specific thermal treatment is given to a nickel based alloy for the sake of the improvement in a stress corrosion cracking resistance (hereinafter referred to as the SCC resistance). For example, Japanese Patent Disclosure No. 25216/1979 discloses a method in which after a final annealing treatment, the alloy is successively heated and retained at a temperature of 550° to 850° C. for a period of 1 to 100 hours in order to deposit a carbide on crystal boundaries, thereby heightening the SCC resistance. Even by such a conventional technique, however, a resistance to the stress corrosion cracking caused by the alkaline concentrate, i.e. an alkali stress corrosion cracking resistance and the pitting corrosion resistance cannot be improved. Further, in fact, the nickel based alloy obtained by such a conventional method cannot always provide a satisfactory combination of the alkali stress corrosion cracking resistance and the pitting corrosion resistance.

SUMMARY OF THE INVENTION

Thus, an object of the present invention is to provide an alloy for a heat transfer pipe excellent in the corrosion resistance, especially an alloy for a heat transfer pipe excellent in the alkali stress corrosion cracking resistance and the pitting corrosion resistance.

Another object of the present invention is to provide an alloy for a heat transfer pipe which can be used particularly advantageously under alkali environments in a steam generator of a pressurized water reactor.

The inventors of the present case have intensively carried on researches for the achievement of such objects, and they have acquired the following knowledges:

(1) The addition of one or more of elements Mo, W and V which are effective for the pitting corrosion resistance permits heightening a passive coating on the alloy in order to improve the pitting corrosion resistance.

(2) The alkali stress corrosion cracking resistance can be remarkably improved by first heating and retaining the alloy for 1 minute or more at a temperature not less than a level at which a carbide in the alloy is thoroughly solubilized, in order to carry out an annealing treatment; cooling it to a temperature of 200° C. or less; and accomplishing the specific thermal treatment for it at a temperature of 600° to 750° C. for a period of 0.1 to 100 hours.

(3) Such an alkali stress corrosion cracking resistance can be improved, together with the aforesaid betterment in the pitting corrosion resistance, by virtue of the addition of one or more of Mo, W and V.

Since the nickel based alloy, inter alia the high Cr-Ni based alloy including 25 to 35% of Cr is small in the solubility of C therein, Cr carbide deposits on crystal boundaries during the cooling process or practical use after the annealing step in order to form Cr-poor layers thereon, so that the stress corrosion cracking will take place thereon. Therefore, when carbon is enough solubilized during the annealing step and the alloy is once cooled to a temperature of 200° C. or less and the thermal treatment is then carried out by heating it again at a temperature within the range of 600° to 750° C. for at most 100 hours, the deposition of Cr carbide ($Cr_{23}C_6$) will be accelerated, but the formation of the Cr-poor layers will positively be inhibited owing to the facilitation of a Cr diffusion from its interior which is brought about by doing the treatment at a heating temperature for a retention time in FIG. 2. Such an effect will lead to the improvement in the stress corrosion cracking resistance, particularly the alkali stress corrosion cracking resistance and the pitting corrosion resistance in combination with the aforesaid effect based on the addition of one or more of Mo, W and V. In this connection, the inventors have known that after the final annealing, by once cooling the alloy to a temperature of 200° C. or less at which no diffusion of Cr substantially occurs in the alloy, the deposition rate of the carbide at the time of the subsequent thermal treatment is unexpectedly remarkably accelerated, as compared with the case where the thermal treatment is successively carried out after the final annealing.

Accordingly, the present invention is characterized by an alloy for heat transfer pipes excellent in an alkali stress corrosion cracking resistance which is obtained by heating and retaining said alloy at a temperature within the range of a temperature (T°C.), at which a carbide in said alloy is thoroughly solubilized, to T+100° C. for 1 minute or more; cooling it once to a level of 200° C. or less; and carrying out a thermal treatment under conditions within a hatched range Z in FIG. 2, said alloy comprising: in terms of % by weight, 0.15% or less of C; 1.0% or less of Si; 1.0% or less of Mn; 25 to 35% of Cr; 40 to 70% of Ni; 0.5% or less of Al; 0.01 to 1.0% of Ti; 0.5 to 5.0%, in all, of one or more of Mo, W and V; 0.030% or less of P; 0.020% or less of S; and the residue of Fe and impurities.

As is definite from the foregoing, the present invention is directed to the alloy for a heat transfer pipe which is excellent in the alkali stress corrosion cracking resistance and the pitting corrosion resistance in the alkaline environments, but in a preferred embodiment, it is directed to the alloy for a heat transfer pipe on the secondary side of a nuclear reactor, for example a heat transfer pipe of a steam generator in a pressurized water reactor.

DETAILED DESCRIPTION OF THE INVENTION

Figure 1:
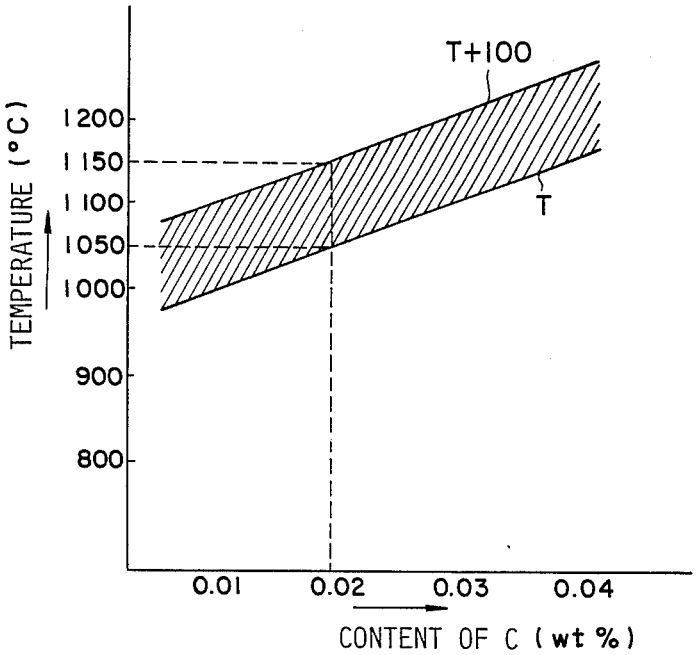
FIG. 1 is a graph showing a temperature range of an annealing treatment regarding the present invention with respect to a content of carbon.

The reason why the composition of the alloy and the conditions of the thermal treatment are restricted as mentioned above in the present invention is as follows:

Carbon (C):

The element C is harmful to the SCC resistance, therefore its content in the present invention is 0.15% or less.

Silicon (Si) and manganese (Mn):

Si and Mn both are deoxidizers, and each amount of them is required to be 1.0% or less. However, when each amount of the elements is above 1.0%, the alloy will have deteriorated welding properties and cleanness.

Chromium (Cr):

The element Cr is an essential component for the maintenance of the corrosion resistance of the alloy according to the present invention. When the content of Cr is less than 25%, it will be impossible to obtain such a corrosion resistance as the present invention requires. On the contrary, when it is above 35%, a hot workability of the alloy will remarkably deteriorate. Therefore, the content of Cr is limited to the range of 25 to 35% in the present invention.

Aluminum (Al):

Al is also necessary as a deoxidizer, but when it is above 0.5%, the cleanness of the alloy will be poor. Therefore, its content is limited to 0.5% or less.

Titanium (Ti):

When 0.01% or more of Ti is added to the alloy, its hot workability will be enhanced; when it is added thereto in an amount above 1.0%, its effect will reach a ceiling level. Therefore, its upper limit is 1.0%.

Phosphorus (P):

The element P is included as an impurity in the alloy. If its content is in excess of 0.030%, it will be harmful to the SCC resistance and the hot workability.

Sulfur (S):

This element is also included as an impurity in the alloy. If its content is above 0.020%, it will be harmful to the crystal boundary etching resistance and the hot workability.

Molybdnum (Mo), tungsten (W) and vanadium (V):

These elements all are effective to heighten the pitting corrosion resistance especially in a high-temperature water including $Cl^-$ ions. When the content of at least one of these elements is 0.5% or less in all, a passive coating on the alloy surface will not be heightened and the pitting corrosion will thus occur. On the contrary, when the total content thereof is more than 5.0%, its effect will reach a ceiling level, and additionally the hot workability will noticeably be deteriorated. Therefore, it is preferred that these elements are added to the alloy in an amount of 1.0% or more in all.

Annealing treatment:

When the annealing operation is carried out below a temperature (hereinafter referred to as T° C.) at which the carbide in the alloy is thoroughly solubilized, a tensile strength, 0.2% yield point and hardness of the alloy will become unreasonably great. On the contrary, when it is done at a temperature about T+100° C., the alloy will have remarkably coarce crystal grains, which fact will lead to the deterioration in the corrosion resistance, i.e. the crystal boundary etching resistance and the crystal boundary stress etching resistance, and the tensile strength, 0.2% yield point and hardness cannot be obtained at predetermined levels. Therefore, the annealing temperature in the present invention are from T°C. to T+100° C. For example, in an embodiment of the alloy including 0.02% of C, an annealing temperature of 1050° to 1150° C. is preferable. Further, with regard to a retention time, for example, a period of 1 to 120 minutes or 1 to 30 minutes is necessary, though it varies with a wall thickness of the pipe to be formed. With regard to a cooling rate, a high cooling rate as in the case of a water cooling is suitable, but other rates in cases of air cooling and oil cooling as well as a low rate in the case of furnace cooling are also acceptable. Special restriction is not imposed on this point. By such a cooling means, the alloy is cooled to, e.g. 200° C. to room temperature.

The above-mentioned temperature at which the carbide in the alloy is thoroughly solubilized varies with a carbon content as exhibited in FIG. 1, but it is, e.g. 950° C. at 0.01% carbon content, 1050° C. at 0.02% content and 1100° C. at 0.03% content.

Figure 2:
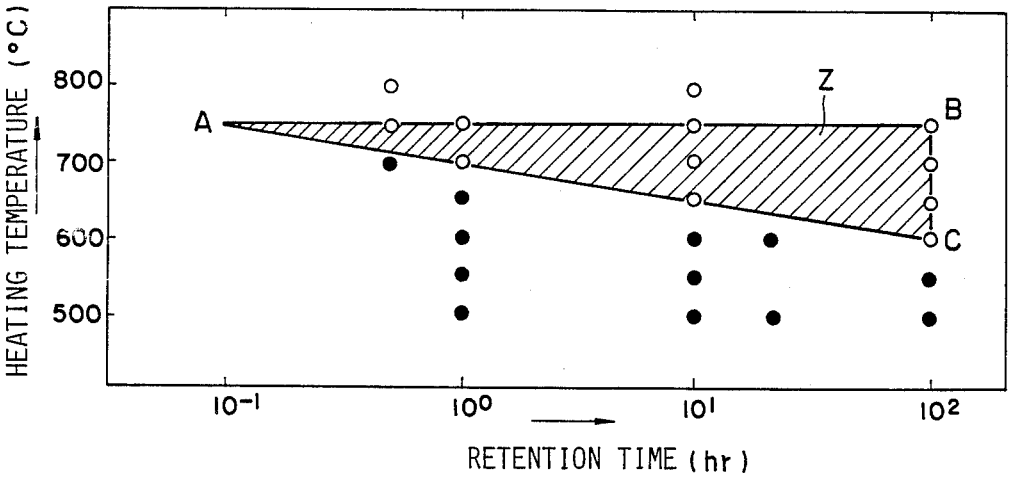
FIG. 2 is a graph drawn by plotting alkali stress corrosion cracking resistances with respect to heating temperatures and retention times of thermal treatment conditions.

Thermal treatment:

After the aforesaid annealing treatment, the specific thermal treatment is carried out by retaining a temperature of 600° to 750° C. for 0.1 to 100 hours as shown in FIG. 2, whereby the carbide will semicontinuously deposit on the crystal boundaries and the Cr-poor layers in the vicinity of positions where the carbide exists will recover, thereby increasing the crystal boundary stress corrosion cracking resistance. The reason why such specific thermal treatment conditions are restricted to the hatched range (Z) in FIG. 2 is as follows: On the left side of the hatched range (Z) in FIG. 2, the retention time is lacking. As a result, the Cr carbide will deposit on the crystal boundaries and the Cr-poor layers formed therearound will not enough recover, so that the SCC resistance cannot be obtained to a satisfactory degree. On the right side in FIG. 2, the hatched range (Z) terminates at a position corresponding to 100 hours. Such a restriction is for an economical reason, though the further prolonged heating treatment is good for the SCC resistance. Moreover, with regard to temperature, when it is less than 600° C., diffusion rates of Cr and C will be low. Hence, in order to cause the Cr-poor layers to recover and to improve the SCC resistance at such a temperature, the very longtime heating operation will be required, which fact is not practical. Therefore, the lower limit of the temperature is set to 600° C.

On the other hand, when the temperature is above 750° C., the recovery of the Cr-poor layers and the betterment in the SCC resistance will be achieved in an extremely short period of time. However, since a difference between this specific heating temperature and a practically used temperature (300° C. or so) is great, the solubilized carbon will deposit in large quantities in the form of the carbide in accordance with a dimension of the difference at the time of a practical use, so that the crystal boundaries tend to be remarkably sensitized. However, if the specific heating temperature is 750° C. or less, the sensitization will be lowered to a negligible degree at the practical use, because the absolute quantity of the solubilized carbon will be small. Therefore, the thermal treatment conditions in the present invention are restricted to the hatched range (Z) surrounded by points A ($10^1$ hours, 750° C.), B ($10^2$ hours, 750° C.) and C ($10^2$ hours, 600° C.) in FIG. 2.

Now, the present invention will be described in accordance with examples, but they are merely exemplary and do not intend to limit the present invention at all.

EXAMPLES 1 TO 18

By a vacuum solubilization, 60%Ni-30%Cr alloys (Alloy Nos. 1 to 18 and comparative Alloys Nos. 19 to 26) chemical compositions of which were set forth in Table 1 were manufactured. The thus manufactured alloys were forged at a temperature of 950° to 800° C. to form them into plates of 25 mm in thickness and were then hot rolled at 1100° C. up to a thickness of 7 mm. Next, they were cold rolled up to a thickness of 4.9 mm and were retained at a final annealing temperature of 1100° C. for 20 minutes. Subsequently, water cooling was carried out to cool them to room temperature and 3 hours' thermal treatment at 600° C. followed (under conditions based on a supposed life in practical environments in use).

From these materials, there were prepared 2-mm-thick×10-mm-wide×75-mm-long specimens for an alkali stress corrosion cracking test and 3-mm-thick×10-mm-wide×40-mm-long specimens for a corrosion test.

The alkali stress corrosion cracking test was accomplished by polishing the specimens with emery paper No. 320; bending them into a U-shape and holding them with bolts and nuts; immersing them in a solution including 30% of NaOH in an autoclave container (a high-temperature and high-pressure container) at 325° C. for 2000 hours; and, after the completion of the immersion process, measuring a depth of cracks by a microscope.

On the other hand, the corrosion test was accomplished by polishing the specimens with emery paper No. 320; immersing them in a solution including 100 ppm of $Cl^-$ ions and having a pH of 4.5 in an autoclave container at 288° C. for 2000 hours; and measuring a corrosion amount.

Figure 3:
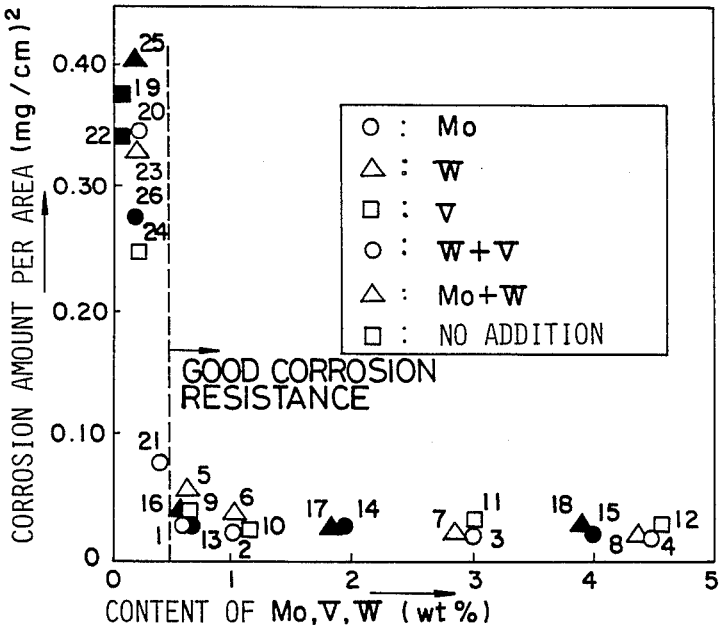
FIG. 3 is a graph showing relations between contents of Mo, V and W and corrosion amounts.

Obtained results are shown in FIGS. 2 and 3 in the form of summary graphs. Numerals in FIG. 3 correspond to the alloy numbers in Table 1.

FIG. 2 presents the stress corrosion cracking test results of the specimens of alloy No. 1 under the above-mentioned alkaline conditions. In this drawing, white circles and black circles represent specimens having cracks less than 25μ in depth and those having cracks more than 25μ in depth, respectively. As be apparent from the drawing, the specimens in the hatched range (Z) surrounded by points A, B and C have good alkali stress corrosion cracking resistance. In this connection, it was confirmed that the alloys according to the present invention other than alloy No. 1 also had substantially similar results.

The data regarding the corrosion resistance in FIG. 3 indicate that when the total content of at least one of Mo, V and W is less than 0.5%, the effect of the corrosion resistance will not be seen, but if its content is 0.5% or more, the corrosion resistance will be improved. This reason would be that the elements of Mo, V and W permit forming the fine and stable passive coating comprising $Cr_2O_3$.

Table 2 summarizes the results of the corrosion resistance under the same conditions as in FIG. 3. In this table, circles, triangles and crosses represent specimens not having any pitting corrosion, those having the slight pitting corrosions and those having the pitting corrosions. It can be understood from these results that the alloys according to the present invention are more excellent in the pitting corrosion resistance, as compared with the conventional alloys. Particularly, when the total amount of Mo, V and W to be added is 1.0% or more, the alloy can have the extremely excellent pitting corrosion resistance.

As be definite from the foregoing, the alloy according to the present invention is excellent in the pitting corrosion resistance, the stress corrosion cracking resistance and the alkali stress corrosion cracking resistance, and, in place of the conventional Alloy 600, the alloy according to the present invention can be thus used, for example, particularly for a heat transfer pipe of a steam generator in a pressurized water reactor.

TABLE 1

(% by weight)

| Alloy No. | C | Si | Mn | P | S | Ni | Cr | Ti | Al | Mo | W | V | Fe |
|---|---|---|---|---|---|---|---|---|---|---|---|---|---|
| Alloys of the Present Invention | | | | | | | | | | | | | |
| 1 | 0.023 | 0.41 | 0.39 | 0.011 | 0.006 | 60.01 | 30.32 | 0.27 | 0.13 | 0.63 | — | — | Residue |
| 2 | 0.025 | 0.43 | 0.41 | 0.013 | 0.009 | 60.15 | 30.17 | 0.25 | 0.15 | 1.04 | — | — | " |
| 3 | 0.026 | 0.49 | 0.41 | 0.013 | 0.009 | 60.44 | 30.19 | 0.27 | 0.13 | 3.03 | — | — | " |
| 4 | 0.022 | 0.41 | 0.38 | 0.012 | 0.009 | 60.35 | 30.45 | 0.23 | 0.14 | 4.50 | — | — | " |
| 5 | 0.021 | 0.43 | 0.43 | 0.012 | 0.008 | 60.15 | 29.89 | 0.20 | 0.15 | — | 0.63 | — | " |
| 6 | 0.025 | 0.42 | 0.38 | 0.013 | 0.009 | 60.25 | 30.35 | 0.21 | 0.15 | — | 1.09 | — | " |
| 7 | 0.025 | 0.42 | 0.41 | 0.012 | 0.008 | 60.37 | 30.11 | 0.19 | 0.15 | — | 2.86 | — | " |
| 8 | 0.028 | 0.41 | 0.43 | 0.009 | 0.007 | 61.21 | 30.23 | 0.25 | 0.14 | — | 4.40 | — | " |
| 9 | 0.021 | 0.43 | 0.42 | 0.012 | 0.010 | 60.28 | 30.16 | 0.27 | 0.15 | — | — | 0.65 | " |
| 10 | 0.023 | 0.42 | 0.37 | 0.011 | 0.008 | 60.19 | 30.01 | 0.30 | 0.13 | — | — | 1.12 | " |
| 11 | 0.027 | 0.40 | 0.38 | 0.011 | 0.010 | 61.26 | 30.46 | 0.29 | 0.14 | — | — | 3.07 | " |
| 12 | 0.029 | 0.43 | 0.40 | 0.011 | 0.009 | 60.39 | 30.47 | 0.33 | 0.13 | — | — | 4.62 | " |
| 13 | 0.026 | 0.38 | 0.40 | 0.009 | 0.009 | 61.03 | 30.69 | 0.22 | 0.13 | — | 0.33 | 0.30 | " |
| 14 | 0.029 | 0.40 | 0.43 | 0.013 | 0.007 | 61.29 | 30.03 | 0.26 | 0.14 | — | 1.10 | 0.8 | " |
| 15 | 0.026 | 0.38 | 0.41 | 0.014 | 0.009 | 60.66 | 31.22 | 0.26 | 0.14 | — | 2.30 | 1.66 | " |
| 16 | 0.029 | 0.44 | 0.36 | 0.011 | 0.010 | 61.09 | 30.68 | 0.21 | 0.13 | 0.29 | 0.30 | — | " |
| 17 | 0.025 | 0.44 | 0.40 | 0.012 | 0.010 | 61.22 | 30.16 | 0.23 | 0.15 | 1.6 | 0.3 | — | " |

TABLE 1-continued (% by weight)

| Alloy No. | C | Si | Mn | P | S | Ni | Cr | Ti | Al | Mo | W | V | Fe |
|---|---|---|---|---|---|---|---|---|---|---|---|---|---|
| 18 | 0.019 | 0.40 | 0.43 | 0.012 | 0.009 | 60.46 | 31.08 | 0.28 | 0.13 | 2.81 | 1.16 | — | " |
| Alloys for Comparison | | | | | | | | | | | | | |
| 19 | 0.029 | 0.38 | 0.41 | 0.012 | 0.009 | 60.38 | 30.76 | 0.22 | 0.14 | — | — | — | " |
| 20 | 0.030 | 0.43 | 0.42 | 0.010 | 0.008 | 61.13 | 31.09 | 0.30 | 0.15 | 0.24 | — | — | " |
| 21 | 0.036 | 0.40 | 0.41 | 0.012 | 0.010 | 60.37 | 31.12 | 0.20 | 0.14 | 0.42 | — | — | " |
| 22 | 0.026 | 0.38 | 0.40 | 0.012 | 0.011 | 61.08 | 30.68 | 0.26 | 0.14 | — | — | — | " |
| 23 | 0.022 | 0.40 | 0.37 | 0.010 | 0.009 | 60.61 | 30.99 | 0.26 | 0.15 | — | 0.22 | — | " |
| 24 | 0.029 | 0.44 | 0.40 | 0.013 | 0.010 | 60.88 | 31.11 | 0.29 | 0.15 | — | — | 0.26 | " |
| 25 | 0.028 | 0.39 | 0.37 | 0.011 | 0.012 | 60.09 | 31.16 | 0.31 | 0.13 | 0.11 | 0.05 | — | " |
| 26 | 0.026 | 0.46 | 0.40 | 0.010 | 0.010 | 60.69 | 30.08 | 0.28 | 0.13 | — | 0.05 | 0.11 | " |

TABLE 2

| Alloy No. | Estimation of Pitting Corrosion Resistance |
|---|---|
| Alloys of the Present Invention | |
| 1 | Δ |
| 2 | O |
| 3 | O |
| 4 | O |
| 5 | Δ |
| 6 | O |
| 7 | O |
| 8 | O |
| 9 | Δ |
| 10 | O |
| 11 | O |
| 12 | O |
| 13 | Δ |
| 14 | O |
| 15 | O |
| 16 | Δ |
| 17 | O |
| 18 | O |
| Alloys for Comparison | |
| 19 | x |
| 20 | x |
| 21 | x |
| 22 | x |
| 23 | x |
| 24 | x |
| 25 | x |
| 26 | x |

What is claimed is:

1. A process for producing an alloy for heat transfer pipes with excellent alkali stress corrosion cracking resistance, said alloy consisting essentially of, in percent by weight:

not more than 0.15% C,
not more than 1.0% Si,
not more than 1.0% Mn,
25 to 35% Cr,
40 to 70% Ni,
not more than 0.5% Al,
0.01 to 1.0% Ti;
0.5 to 5.0% of a metal selected from the group consisting of Mo, W van V and mixtures thereof,
not more than 0.030% P,
not more than 0.020% S and the balance Fe and impurities, which process comprises (1) maintaining a mixture containing the metallic components at a temperature from T°C. to (T°C.+100° C.), where T°C. is the temperature at which a carbide in the alloy is solubilized, for a period of from 1 to 120 minutes, (2) cooling the resulting mixture to a temperature of from room temperature to 200° C., and (3) thermally treating the resulting product at a temperature from 600° to 750° C. for a period of time from 0.1 to 100 hours while the mixture is within the area defined by the hatched portion of FIG. 2 hereof.

* * * * *